US010862247B2

(12) United States Patent
Hashimoto et al.

(10) Patent No.: US 10,862,247 B2
(45) Date of Patent: Dec. 8, 2020

(54) INNER CONDUCTOR TERMINAL AND SHIELD TERMINAL

(71) Applicant: Sumitomo Wiring Systems, Ltd., Mie (JP)

(72) Inventors: Norihito Hashimoto, Mie (JP); Keisuke Kanemura, Mie (JP); Motoki Kubota, Mie (JP); Liping Kang, Mie (JP); Shohei Mitsui, Mie (JP); Wataru Yamanaka, Mie (JP); Masanobu Kasuga, Mie (JP); Ai Hirano, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/733,300

(22) Filed: Jan. 3, 2020

(65) Prior Publication Data

US 2020/0220305 A1 Jul. 9, 2020

(30) Foreign Application Priority Data

Jan. 8, 2019 (JP) ..... 2019-001010

(51) Int. Cl.

| | |
|---|---|
| ***H01R 4/10*** | (2006.01) |
| ***H01R 13/6473*** | (2011.01) |
| ***H01R 13/04*** | (2006.01) |
| ***H01R 13/6592*** | (2011.01) |
| ***H01R 13/405*** | (2006.01) |
| ***H01R 12/57*** | (2011.01) |

(52) U.S. Cl.

CPC ..... *H01R 13/6473* (2013.01); *H01R 12/57* (2013.01); *H01R 13/04* (2013.01); *H01R 13/405* (2013.01); *H01R 13/6592* (2013.01)

(58) Field of Classification Search

CPC ..... H01R 13/6473; H01R 13/04; H01R 13/6592; H01R 13/405; H01R 12/57; H01R 2103/00; H01R 12/724; H01R 24/50

USPC ..... 439/879, 891, 885, 79, 629

See application file for complete search history.

(56) References Cited

U.S. PATENT DOCUMENTS 3,348,187 A * 10/1967 Friend ..... H01R 13/62933 439/51

4,031,614 A * 6/1977 Gipe ..... H01R 43/16 29/879

(Continued)

FOREIGN PATENT DOCUMENTS

JP 2012-022885 2/2012

*Primary Examiner* — Abdullah A Riyami

*Assistant Examiner* — Nelson R. Burgos-Guntin

(74) *Attorney, Agent, or Firm* — Gerald E. Hespos; Michael J. Porco; Matthew T. Hespos

(57) ABSTRACT

An inner conductor terminal (10) is made of a metal plate and includes tubular first terminal portion (11) and second terminal portion (12) each having an opening end. A bent portion (15) links the first and second terminal portions (11, 12) and covers the respective opening ends of the first and second terminal portions (11, 12) by facing the openings. A tab (13) projects from an end of the first terminal portion (11) opposite to the opening end, and a lead (14) projects from an end part of the second terminal portion (12) opposite from the opening end. The inner conductor terminal (10) includes two side panels (16) projecting from the second terminal portion (12) to be located at both sides of the bent portion (15) and covering a clearance between the bent portion (15), the first terminal portion (11) and the second terminal portion (12) from both sides.

4 Claims, 9 Drawing Sheets

(56) References Cited

U.S. PATENT DOCUMENTS 4,072,394 A * 2/1978 Waldron ..... H01R 13/111 439/697
4,889,500 A * 12/1989 Lazar ..... H01R 13/6585 439/579
5,133,677 A * 7/1992 Sato ..... H01R 9/0518 439/585
5,186,656 A * 2/1993 Harwath ..... H01R 24/40 439/585
5,399,110 A * 3/1995 Morello ..... H01R 4/185 439/879
6,200,162 B1 * 3/2001 Aoyama ..... H01R 4/184 439/578
6,217,379 B1 * 4/2001 D'Hulster ..... H01R 13/04 439/752.5
6,217,381 B1 * 4/2001 Kameyama ..... H01R 9/0518 439/578
6,384,335 B1 * 5/2002 Saito ..... H01R 9/0518 174/74 R
6,709,290 B2 * 3/2004 Yoshida ..... H01R 9/0518 439/585
6,808,417 B2 * 10/2004 Yoshida ..... H01R 9/0518 439/585
7,140,914 B2 * 11/2006 Kojima ..... H01R 4/185 439/585
D568,245 S * 5/2008 Kudo ..... D13/133
7,980,894 B1 * 7/2011 Hall ..... H01R 9/053 439/585
8,708,719 B2 * 4/2014 Iihoshi ..... H01R 13/434 439/140
9,028,278 B2 * 5/2015 Kanda ..... H01R 13/6474 439/607.51
9,033,733 B2 * 5/2015 Takahashi ..... H01R 4/185 439/585
9,960,550 B2 * 5/2018 Ensley ..... H01R 13/631
10,096,927 B2 * 10/2018 Hashiguchi ..... H01R 13/506
10,147,523 B2 * 12/2018 Rengert ..... H01B 11/1091
10,348,023 B2 * 7/2019 Hirota ..... H01R 13/4223
10,355,463 B2 * 7/2019 Inoue ..... H05K 9/0007
10,511,115 B2 * 12/2019 Hirota ..... H01R 13/4365
10,511,116 B2 * 12/2019 Maesoba ..... H01R 13/658
10,594,057 B2 * 3/2020 Kanemura ..... H01R 4/20
10,644,416 B2 * 5/2020 Kanemura ..... H01R 13/639
10,741,961 B2 * 8/2020 Nishida ..... H01R 13/50
10,741,976 B1 * 8/2020 Maesoba ..... H01R 13/6593
10,741,977 B2 * 8/2020 Maesoba ..... H01R 13/502
10,770,855 B2 * 9/2020 Nakanishi ..... H01R 43/0256
2005/0287875 A1 * 12/2005 Kojima ..... H01R 24/44 439/750
2006/0216970 A1 * 9/2006 Pavlovic ..... H01R 43/0256 439/83
2007/0238353 A1 * 10/2007 Yamaoka ..... H01R 13/642 439/595
2010/0015864 A1 * 1/2010 Zaitsu ..... H01R 43/16 439/885
2010/0093233 A1 * 4/2010 Friesen ..... H01R 4/185 439/879
2015/0200481 A1 * 7/2015 Fukushima ..... B60L 53/16 439/752
2019/0013614 A1 * 1/2019 Matsui ..... H01R 13/6581
2019/0199012 A1 * 6/2019 Hirata ..... H01R 13/521
2019/0199013 A1 * 6/2019 Kanemura ..... H01R 9/0518
2020/0076147 A1 * 3/2020 Nakanishi ..... H01R 12/716
2020/0220305 A1 * 7/2020 Hashimoto ..... H01R 13/405
2020/0274265 A1 * 8/2020 Hashimoto ..... H01R 13/5812
2020/0274298 A1 * 8/2020 Hashimoto ..... H01R 13/6594
2020/0274299 A1 * 8/2020 Hashimoto ..... H01R 13/502

* cited by examiner

INNER CONDUCTOR TERMINAL AND SHIELD TERMINAL

BACKGROUND

Field of the Invention

The invention relates to an inner conductor terminal and a shield terminal.

Related Art

Japanese Unexamined Patent Publication No. 2012-22885 discloses a shield terminal with an inner conductor terminal, an outer conductor terminal covering the outer periphery of the inner conductor terminal and a dielectric provided between the inner conductor terminal and the outer conductor terminal. The shield terminal is accommodated in a connector housing disposed on a surface of a circuit board.

The inner conductor terminal includes a pin-like connecting portion, a rectangular press-in portion behind the pin-like connecting portion, and a terminal body behind the rectangular press-in portion. The inner conductor terminal is inserted into a terminal accommodating portion of the dielectric from behind. The pin-like connecting portion is cylindrical, projects forward of the dielectric and is connected to a mating terminal. The rectangular press-in portion is wider than the pin-like connecting portion and includes a locking projection to be locked to the dielectric. A first lead is bent at the rear end of the terminal body and includes a first connecting portion to be soldered to the surface of the circuit board. The inner conductor terminal as a whole has a crank shape Impedance between the inner conductor terminal and the outer conductor terminal can be matched in combination with the thickness of the dielectric by forming the inner conductor terminal into a tubular shape. However, the above-described inner conductor terminal has a bend at an intermediate position and it is difficult to bend the tubular shape. If a clearance is formed in the inner conductor terminal due to the tubular shape interrupted at the bent part, a distance between the inner conductor terminal and the outer conductor terminal changes and a predetermined impedance cannot be maintained. As a result, an impedance mismatch may be caused at the bend of the inner conductor terminal and a good transmission characteristic of a high-frequency signal may be impaired.

The invention was completed on the basis of the above situation and aims to provide an inner conductor terminal capable of impedance matching and a shield terminal with the inner conductor terminal.

SUMMARY

The invention is directed to an inner conductor terminal made of a metal plate and including tubular first terminal portion and second terminal portion each having an open end. A bent portion links the first and second terminal portions and covers the open end of each of the first and second terminal portions by facing the open ends. A tab projects from an end part of the first terminal portion opposite to the open end, and a lead projects from an end part of the second terminal portion opposite from the open end. Two side portions project from at least one of the first terminal portion and the second terminal portion to be located at both sides of the bent portion. The side portions cover a clearance between the bent portion, the first terminal portion and the second terminal portion from both sides.

The bent portion is provided between the first and second terminal portions and covers the openings of the respective open ends of the first and second terminal portions. Additionally, side portions cover the clearance between the bent portion, the first terminal portion and the second terminal portion from the both sides. Thus, a space between the first and second terminal portions is surrounded by the bent portion and the side portions. In this way, an impedance mismatch between the first and second terminal portions can be prevented. As a result, impedance matching is possible and the transmission of a good high-frequency signal can be achieved.

The lead may project from an outer wall continuous with the bent portion in the second terminal portion. According to this configuration, a distance between the outer wall of the second terminal portion and the outer conductor terminal and a distance between the lead and the outer conductor terminal can be made equal. Thus, impedance matching also is possible on the side of the lead portion.

A shield terminal with the above inner conductor terminal may include a dielectric for accommodating the inner conductor terminal, and an outer conductor terminal for surrounding the dielectric. The first terminal is inserted into an accommodating portion of the dielectric from behind, and rear ends of the side portions are exposed on a rear surface of the dielectric. According to this configuration, the first terminal portion can be inserted into the accommodating portion of the dielectric by pressing the rear ends of the side portions with a finger or tool. That is, the side portions can be utilized as an operating portion when assembling the inner conductor terminal.

The outer conductor terminal may include a surrounding portion for accommodating the dielectric, and a thickness of the dielectric defined between an inner surface of the surrounding portion and the first terminal portion may be constant in a front-rear direction. For example, an opening part of the accommodating portion could be formed and reduced in diameter, and the thickness of the dielectric would change, thereby making it difficult to precisely match impedances. However, according to the above configuration, the thickness of the dielectric, including the opening part of the accommodating portion, does not change and impedances can be matched precisely.

DETAILED DESCRIPTION

Figure 1:
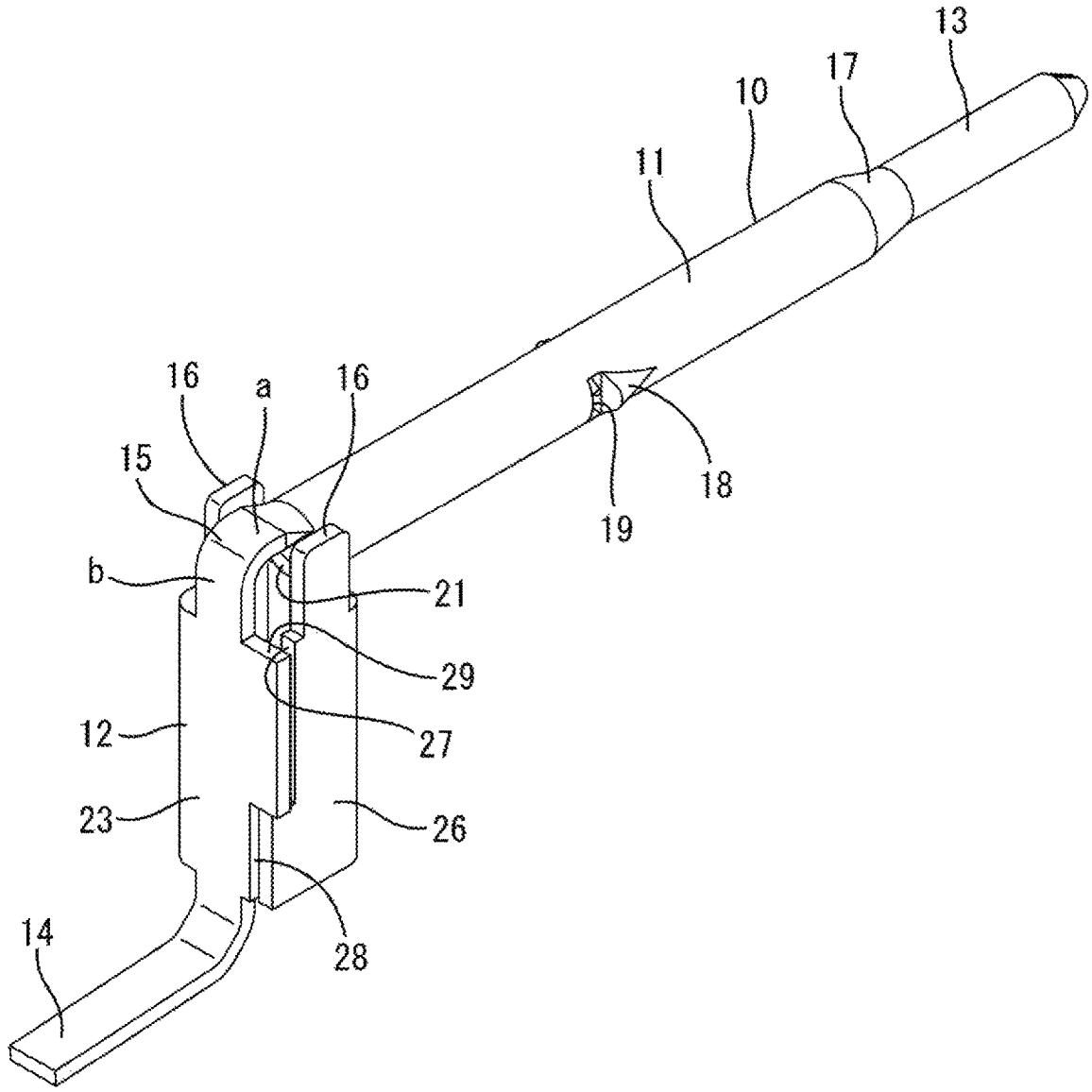
FIG. 1 is a perspective view of an inner conductor terminal in one embodiment of the present invention.

One embodiment of the invention is described with reference to FIGS. 1 to 9. An inner conductor terminal 10 of this embodiment is configured as one component of a shield terminal 100. The shield terminal 100 includes a dielectric 40 and an outer conductor terminal 60 besides the inner conductor terminal 10. The shield terminal 100 is accommodated in a connector housing 80.

(Connector Housing 80)

Figure 9:
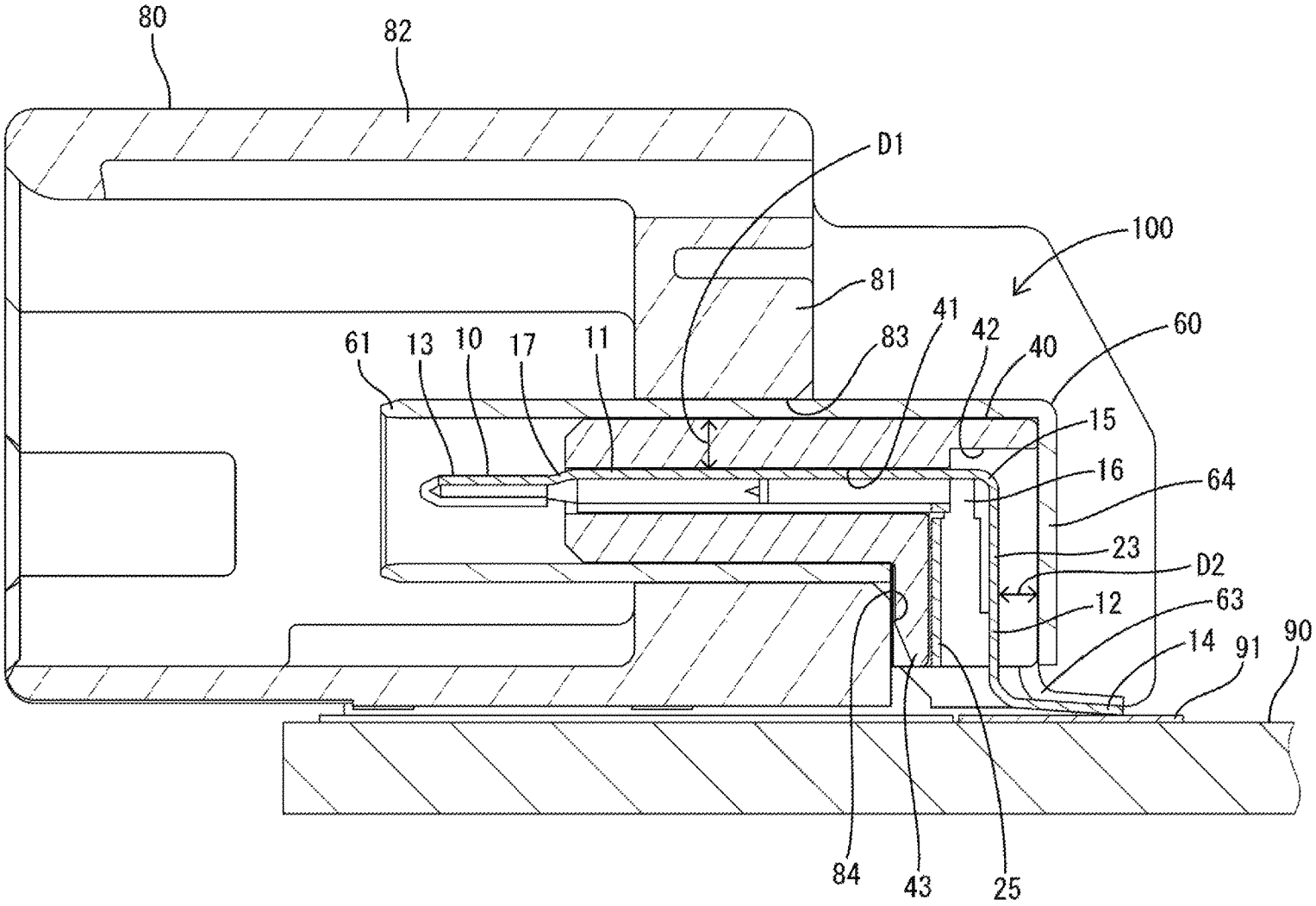
FIG. 9 is a section of a shielded connector.

The connector housing 80 is made of synthetic resin and is disposed on a surface (upper surface) of a circuit board 90, as shown in FIG. 9. The connector housing 80 includes a mounting portion 81 substantially along a vertical direction and a receptacle 82 projecting forward (right in FIG. 9) from the outer periphery of the mounting portion 81. A through hole 83 penetrates the mounting portion 81 in a front-rear direction.

(Outer Conductor Terminal 60)

The outer conductor terminal 60 is formed integrally, such as by bending a conductive metal plate. The outer conductor terminal 60 includes a hollow cylindrical surrounding portion 61 for surrounding the outer periphery of the inner conductor terminal 10. An axis of the surrounding portion 61 is oriented in the front-rear direction, and an unillustrated mating outer conductor terminal is inserted into the surrounding portion 61 from the front for connection. The mating outer conductor terminal is connected to a shield layer of an unillustrated shielded cable.

Figure 8:
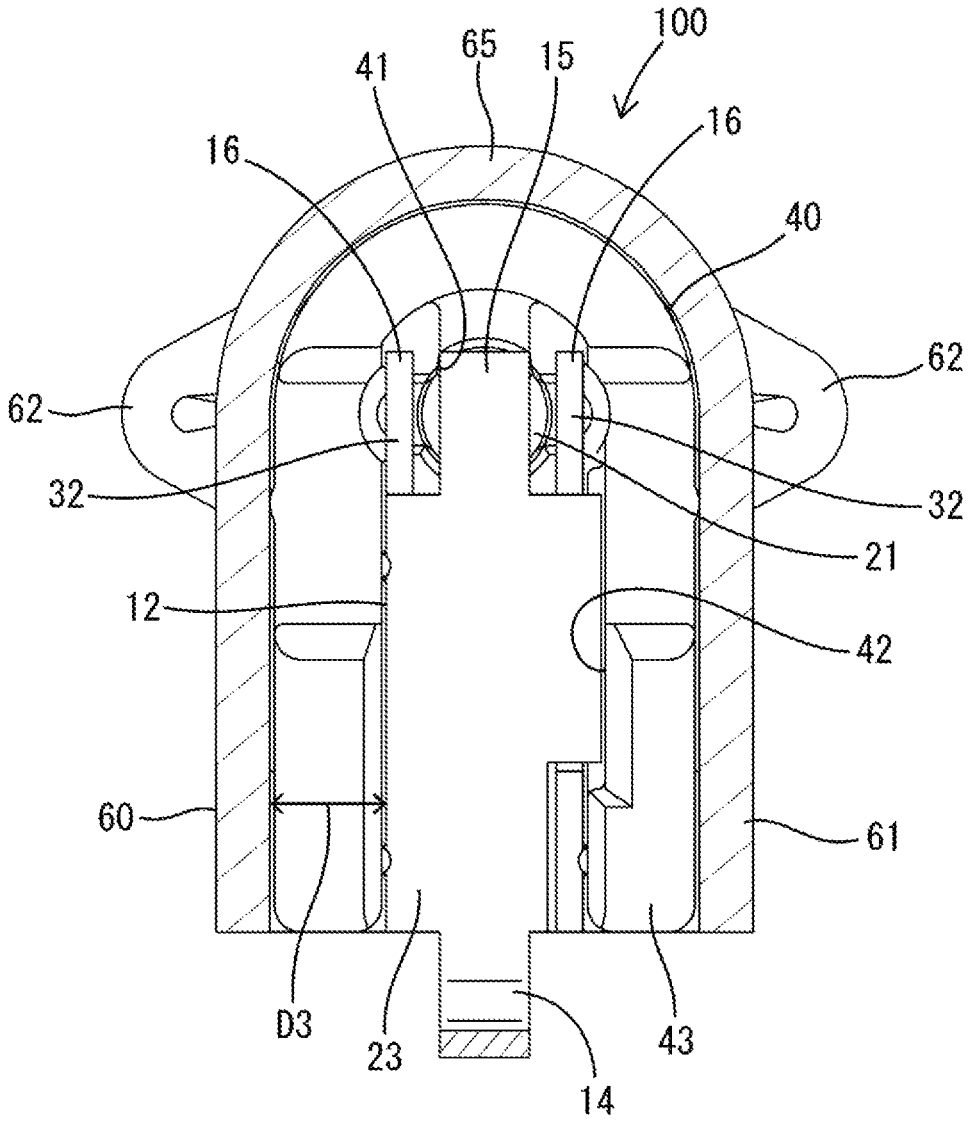
FIG. 8 is a section along B-B of FIG. 7.

Two locking pieces 62 protrude respectively to the left and right from the surrounding portion 61, as shown in FIG. 8. The outer conductor terminal 60 is inserted through the through hole 83 of the mounting portion 81 and is mounted into the connector housing 80 by locking the locking pieces 62 to the mounting portion 81. As shown in FIG. 9, a front part of the surrounding portion 61 is arranged to project into the receptacle 82.

Figure 7:
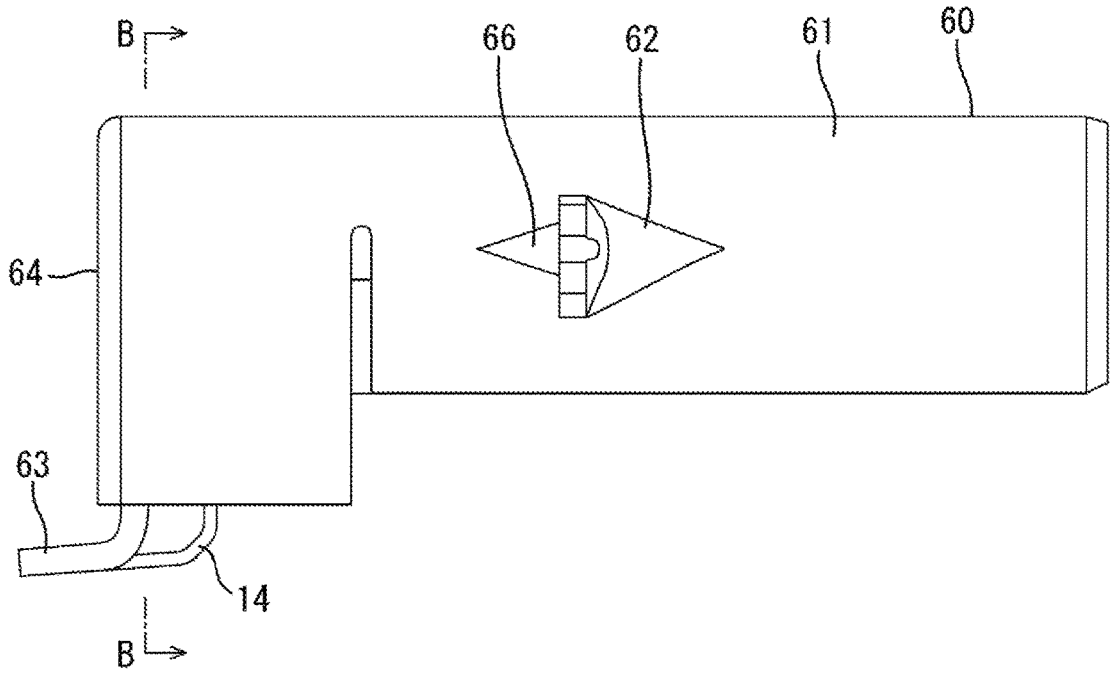
FIG. 7 is a side view of a shield terminal.

Two connecting pieces 63, only one of which is shown in FIGS. 7 and 9, extend down from a lower part of the rear end of the outer conductor terminal 60 and then are bent rearward. Each connecting piece 63 is connected by soldering to an unillustrated ground on the surface of the circuit board 90. An opening in the rear surface of the outer conductor terminal 60 is closed by a cover 64 in the form of a flat plate.

(Dielectric 40)

The dielectric 40 is made of synthetic resin, is block-shaped and, as shown in FIG. 9, is inserted from behind into the surrounding portion 61 of the outer conductor terminal 60. An accommodating portion 41 penetrates the dielectric 40 in the front-rear direction and, as shown in FIG. 8, forms a circular opening that is substantially concentric with an arcuate peripheral wall 65 of the surrounding portion 61 when the dielectric 40 is accommodated in the surrounding portion 61. The circular opening defined by the accommodating portion 41 is of constant diameter over the entire length in the front-rear direction.

As shown in FIGS. 8 and 9, an inserting portion 42 is provided in a rear part of the dielectric 40 and can receive a later-described second terminal portion 12, a bent portion 15 and two side panels 16 of the inner conductor terminal 10. The inserting portion 42 is open rearward and down. A wall 43 projects down on the lower end of the rear part of the dielectric 40. As shown in FIG. 9, the wall 43 is aligned vertically and closes a front part of the inserting portion 42. The wall 43 is substantially in contact with the lower part of the rear edge of the surrounding portion 61 of the outer conductor terminal 60 and with a step surface 84 of the mounting portion 81 of the connector housing 80. The dielectric 40 is locked by a locking claw 66 (see FIG. 7) projecting into the outer conductor terminal 60 and is retained in the surrounding portion 61.

(Inner Conductor Terminal 10)

Figure 4:
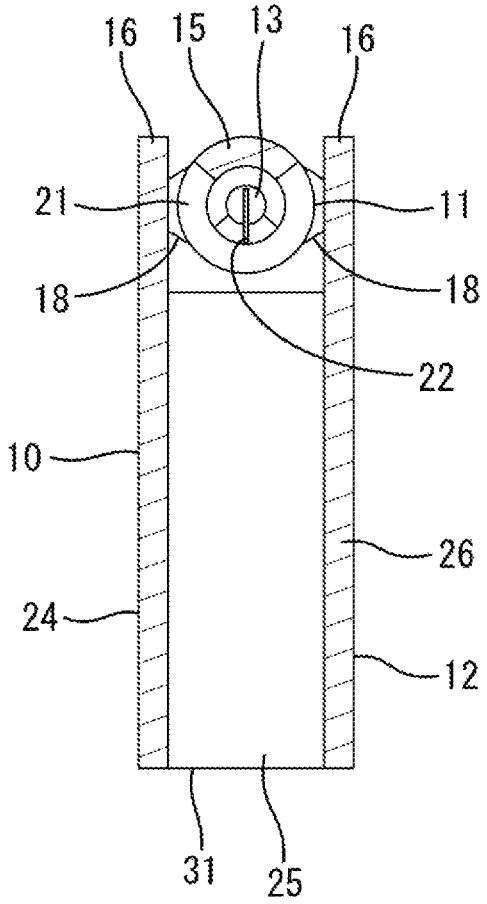
FIG. 4 is a section along A-A of FIG. 3.
Figure 5:
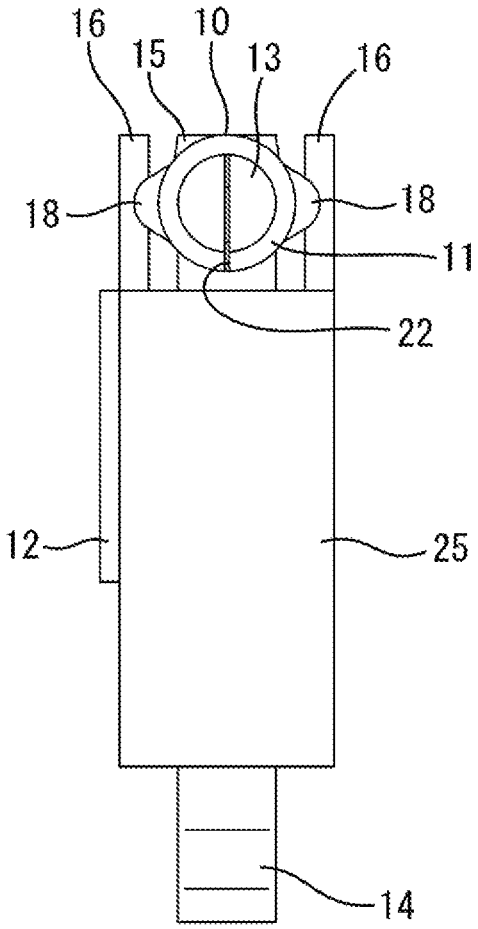
FIG. 5 is a front view of the inner conductor terminal.
Figure 6:
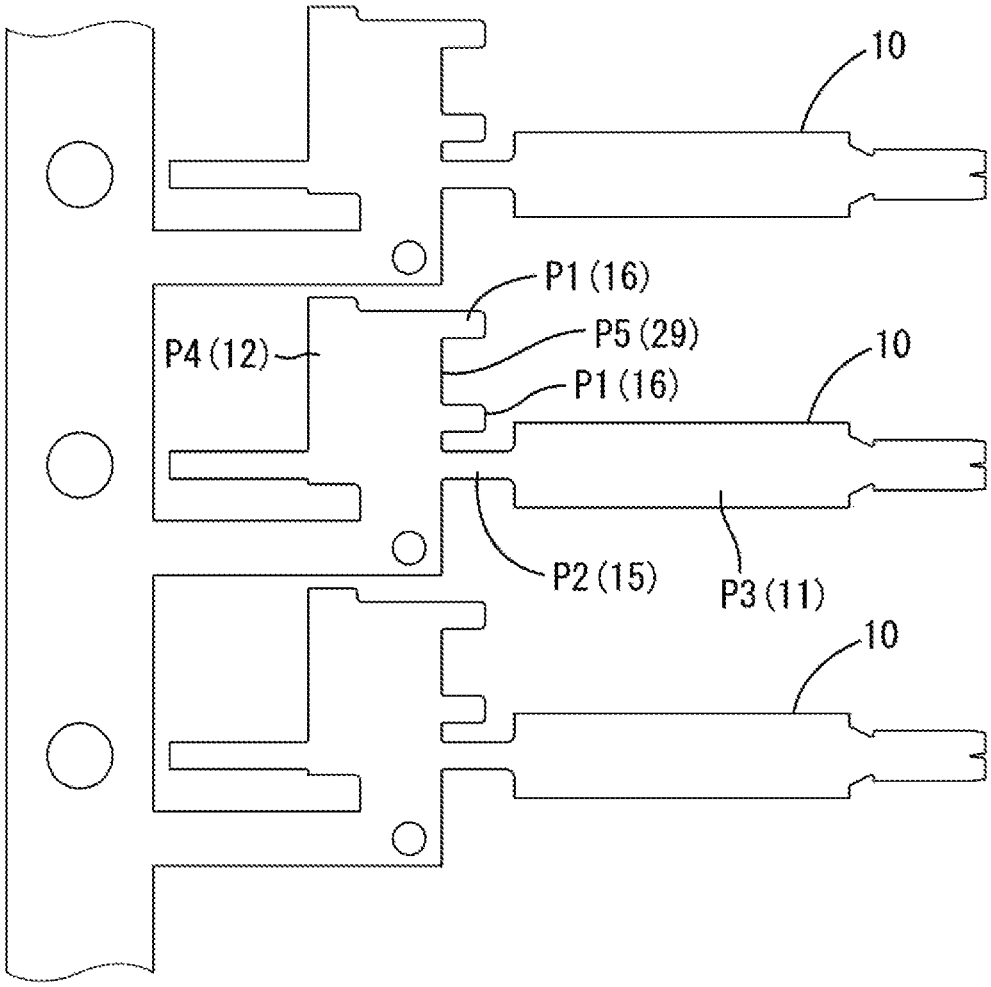
FIG. 6 is a development in a chained state of inner conductor terminals.

The inner conductor terminal 10 is formed integrally, such as by bending a conductive metal plate (see FIG. 6). As shown in FIGS. 1 to 5, the inner conductor terminal 10 includes a first terminal portion 11, the second terminal portion 12, a tab 13, a lead 14, the bent portion 15 and the two side panels 16.

Figure 3:
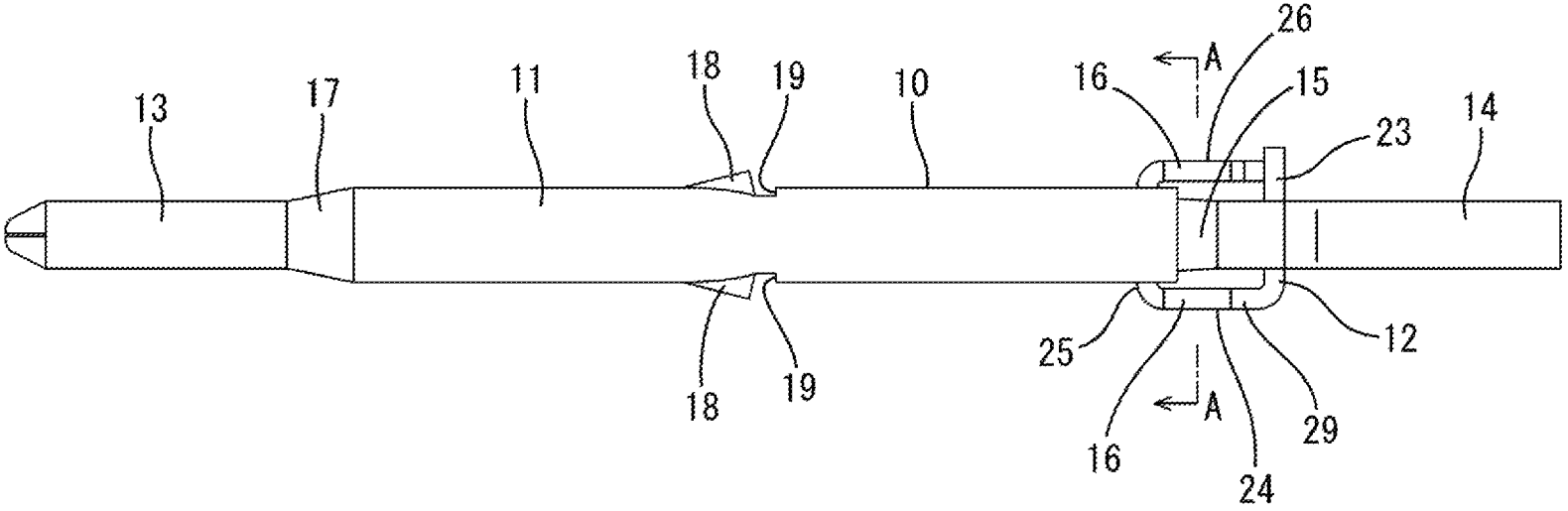
FIG. 3 is a plan view of the inner conductor terminal.

The first terminal portion 11 has a hollow cylindrical tubular shape with an axis oriented in the front-rear direction. As shown in FIG. 9, the first terminal portion 11 is inserted into the accommodating portion 41 of the dielectric 40 from behind, and a front part of the first terminal portion 11 includes a guide 17 tapered toward the front. As shown in FIGS. 3 to 5, an intermediate part of the first terminal portion 11 in the front-rear direction has two locks 18. The locks 18 are cut via vertical slits 19 (see FIGS. 1 to 3) in the first terminal portion 11 and are deformed to protrude respectively to the left and right. The first terminal portion 11 has a constant diameter along the front-rear direction except at the guide 17 and the locks 18. An outer diameter of the first terminal portion 11, except at the guide 17 and the locks 18, is equal to or slightly smaller than an inner diameter of the accommodating portion 41. With the first terminal portion 11 accommodated in the accommodating portion 41, the guide 17 faces an opening on the front end of the accommodating portion 41.

Figure 2:
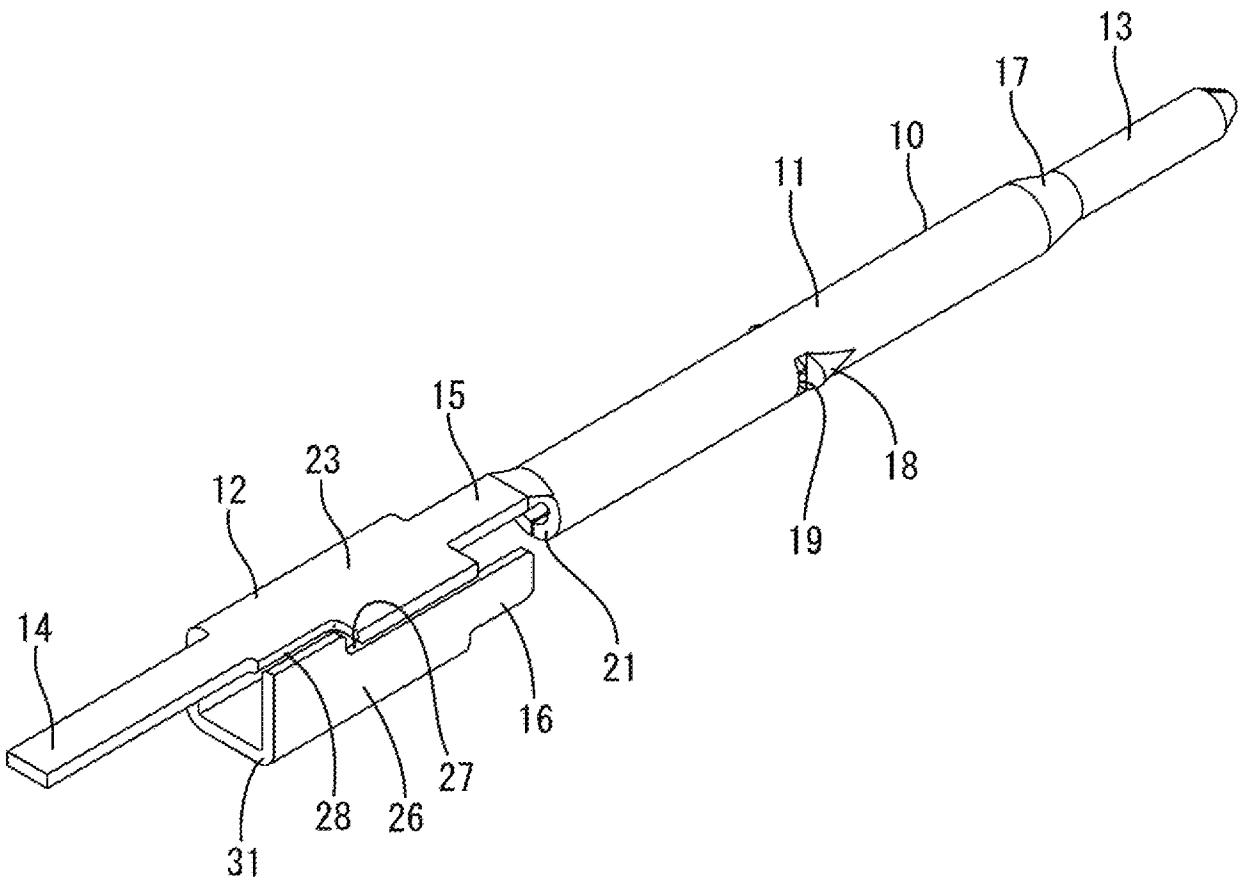
FIG. 2 is a perspective view of the inner conductor terminal before being bent.

As shown in FIGS. 1 and 2, the rear end of the first terminal portion 11 is configured as a first opening end 21 circular in a back view. The first opening end 21 is open rearward and closed by the bent portion 15 except at both left and right sides.

The tab 13 is a hollow cylinder extending forward from the front end of the guide 17, and a front end of the tab 13 is constricted and closed to form a tip. The tab 13 extends in the front-rear direction while having the same diameter except at the tip. As shown in FIG. 9, the tab 13 projects forward from the front end of the dielectric 40 and is surrounded by the surrounding portion 61 of the outer conductor terminal 60. The tab 13 is inserted into a box portion of an unillustrated mating inner conductor terminal for connection.

As shown in FIG. 5, the first terminal portion 11 and the tab 13 include butting end edges 22 extending over the entire lengths in the front-rear direction in laterally central parts of lower ends. The tab 13 and the first terminal portion 11 are bent arcuately to butt the butting end edges 22 against each other, thereby maintaining the hollow cylindrical shapes of the tab portion 13 and the first terminal portions 11.

The second terminal portion 12 is a rectangular tube with a vertical axis. The second terminal portion 12 is composed of an outer wall 23, a first side wall 24, an inner wall 25 and a second side wall 26, all of which are substantially flat rectangular plates aligned vertically, as shown in FIGS. 1 and 4. The outer wall faces rearward, as shown in FIG. 1. The first side wall 24 is bent forward from a first side (left side in FIG. 1) of the outer wall 23 and face toward the second side wall, as shown in FIG. 4. The inner wall 25 is bent toward the second side (right side of FIG. 4) from the front end of the first side wall 24 and faces forward. The second side wall 26 is bent rearward from the second side (right side of FIG. 4) of the inner wall 25 and faces toward the second side.

As shown in FIG. 1, a side recess 27 is cut in an upper part of the rear edge of the second side wall 26 and has an L shape in a side view. A rear recess 28 is cut in a lower part of the second side edge of the outer wall 23 and has an L shape in a back view. An upper part of the second side edge of the outer wall 23 is fit into the side recess 27 of the second side wall 26, and a lower part of the rear end of the second side wall 26 is fit into the rear recess 28 of the outer wall 23. Thus, the second side edge of the outer wall 23 and the rear edge of the second side wall 26 are meshed at the recesses 27 and 28 to main the rectangular tubular shape of the second terminal portion 12. As shown in FIG. 9, the front surface of the inner wall 25 is arranged substantially in contact with the wall 43 in the inserting portion 42 of the dielectric 40.

As shown in FIGS. 1 and 3, the upper end of the second terminal portion 12 has a second opening end 29 rectangular in a plan view. The second opening end 29 is open upward and is closed by the bent portion 15 except at left and right sides. As shown in FIG. 4, the lower end of the second terminal portion 12 has a lower opening end 31 rectangular in a bottom view. The lower opening end 31 is open downward.

As shown in FIG. 1, the lead 14 is integral with the outer wall 23 of the second terminal portion 12. The lead 14 is a strip bent to extend rearward after projecting down from the outer wall 23. The lead 14 is slightly narrower than the outer wall 23 (second terminal portion 12). As shown in FIG. 9, the lower surface of the lead 14 is arranged along the surface of the circuit board 90 and is connected to a conductive portion 91 formed on the surface of the circuit board 90 by soldering. The lead 14 is arranged laterally side by side with the respective connecting pieces 63 of the outer conductor terminal 60.

The bent portion 15 is between the first and second terminal portions 11 and 12. As shown in FIG. 1, the bent portion 15 is a strip curved from a front end to a lower end. The front end is integral with the rear end (first opening end 21) of the upper part of the first terminal portion 11 and the lower end is integral with the upper end (second opening end 29) of the outer wall 23 of the second terminal portion 12. Thus, the first and second terminal portions 11 and 12 are coupled by the bent portion 15. The bent portion 15 is slightly narrower than the outer wall 23 and is substantially equal in width to the lead 14.

The bent portion 15 is bent from a straight state shown in FIG. 2 in which the first terminal portion 11 and the second terminal portion 12 are located one after the other in the front-rear direction to a curved state shown in FIG. 1 in which the first terminal portion 11 and the second terminal portion 12 are substantially perpendicular to each other.

As shown in FIG. 1, a part "a" of the bent portion 15 extending rearward from the upper part of the first terminal portion 11 faces the second opening end 29 of the second terminal portion 12 to cover the second opening end 29 from above, and a part "b" extending up from the outer wall 23 of the second terminal portion 12 faces the first opening end 21 of the first terminal portion 11 to cover the first opening end 21 from behind.

As shown in FIGS. 1 and 3 to 5, the two side panels 16 project integrally up from the respective upper ends (second opening end 29) of the first and second side walls 24 and 26 of the second terminal portion 12.

As shown in FIG. 1, the side panels 16 are flat rectangular plates in a side view and cover the inside of the bent portion 15 from left and right sides. Specifically, the side panels 16 are arranged to cover and close a space formed between the bent portion 15, the first terminal portion 11 and the second terminal portion 12 from both left and right sides.

As shown in FIGS. 4 and 5, the upper ends of the respective side panels 16 are arranged substantially at the same heights as or slightly higher than the upper end of the bent portion 15. The inner surfaces of the respective side panels 16 are flat plate surfaces along the vertical direction (height direction) and the lateral direction (width direction) and, as shown in FIG. 8, are spaced from both left and right ends of the bent portion 15. Rear end surfaces 32 of the respective side panels 16 are plate thickness surfaces along the vertical direction and can function as operating surfaces to be pressed by a finger or tool when assembling the inner conductor terminal 10 with the dielectric 40.

As shown in FIG. 6, formation areas P1 of the side panels 16 and a formation area P2 of the bent portion 15 in a developed state of the inner conductor terminal 10 (before being bent) are arranged side by side on a formation area P5 of the second opening end 29 between formation areas P3, P4 of the respective first and second terminal portions 11, 12. Thus, material waste when cutting a metal plate is eliminated in forming the side panels 16.

Next, functions and effects of this embodiment are described.

The inner conductor terminal 10 is assembled with the dielectric 40 from behind. The first terminal portion 11 is inserted and accommodated into the accommodating portion 41 of the dielectric 40, and the second terminal portion 12, the bent portion 15, the respective side panels 16 are inserted and accommodated into the inserting portion 42 of the dielectric 40. The side panels 16 are arranged along the height direction in the inserting portion 42 of the dielectric 40 and can be confirmed visually from behind (see FIG. 8). The first terminal portion 11 can be inserted smoothly into the accommodating portion 41 by pressing the rear surfaces 32 of the side panels 16 with the finger or tool. The inner wall 25 of the second terminal portion 12 contacts the wall 43 of the dielectric 40 to stop insertion of the inner conductor terminal 10. Further, the locks 18 of the inner conductor terminal 10 bite into the inner peripheral surface of the accommodating portion 41 to be locked, thereby restricting the escape of the inner conductor terminal 10 from the accommodating portion 41.

With the inner conductor terminal 10 properly assembled with the dielectric 40, the first terminal portion 11 is accommodated in the accommodating portion 41 substantially over the entire length in the front-rear direction and contacts the accommodating portion 41 substantially over the entire circumference (see FIG. 9). The tab 13 projects forward from the front of the dielectric 40. Further, the guide 17 of the first terminal portion 11 also projects forward from the front of the dielectric 40 except at a rear part. The inner conductor terminal 10 penetrates a substantially radially central part of the dielectric 40.

The dielectric 40 is assembled with the outer conductor terminal 60 from behind. The cover 64 of the outer conductor terminal 60 is retracted to open the opening in the rear surface prior to the assembling of the dielectric 40. The dielectric 40 is held in the surrounding portion 61 of the outer conductor terminal 60 by the locking claw 66 and is arranged substantially in contact with and along the inner peripheral surface of the surrounding portion 61. The outer conductor terminal 60 has the opening in the rear surface closed by the cover 64 after assembling the dielectric 40. The outer conductor terminal 60 then is inserted into the through hole 83 of the housing 80 to be held from behind (see FIG. 9). Further, an unillustrated mating connector housing is fit into the receptacle 82, the mating outer conductor terminal is connected to the outer conductor terminal 60 and the unillustrated mating inner conductor terminal is connected to the inner conductor terminal 10.

As shown in FIG. 9, the first terminal portion 11 is arranged, together with the tab 13, coaxially in a substantially radially central part of the surrounding portion 61 of the outer conductor terminal 60. Thus, a radial distance D1 (equivalent to a thickness of the dielectric 40) between the outer peripheral surface of the first terminal portion 11 and the surrounding portion 61 is substantially constant in the front-rear direction. A distance D2 between the outer wall 23 of the second terminal portion 12 and the cover 64 is approximate to the distance D1 and substantially constant in the vertical direction. The bent portion 15 is interposed between the outer wall 23 of the second terminal portion 12 and the upper part of the first terminal portion 11 and a distance between the bent portion 15 and the outer conductor terminal 60 is also not largely different from the distance D2.

A distance D3 (see FIG. 8) between the first side wall 24 and the second side wall 26 of the second terminal portion 12 and side surface parts of the outer conductor terminal 60 is also approximate to the distance D2 and substantially constant in the vertical direction. The respective side panels 16 project on the respective upper ends of the first and second side walls 24 and 26, and a distance between the respective side panels 16 and the side surface parts of the outer conductor terminal 60 is also not largely different from the distance D3.

Accordingly, a distance between the inner conductor terminal 10 and the outer conductor terminal 60 does not change significantly in the entire area from the first terminal portion 11 to the second terminal portion 12. Thus, a predetermined impedance can be maintained between the inner conductor terminal 10 and the outer conductor terminal 60.

More particularly in the case of this embodiment, the space between the first opening end 21 of the first terminal portion 11 and the second opening end 29 of the second terminal portion 12 is covered and closed by the bent portion 15 and the respective side panels 16. Specifically, the bent portion 15 faces the respective openings of the first and second opening ends 21, 29 to cover the respective openings (see reference signs a, b of FIG. 1), and the side panels 16 at both sides of the bent portion 15 cover the space from both sides. Thus, there is no clearance open rearward and in the lateral direction as would exist in a bend between the first terminal portion 11 and the second terminal portion 12, and impedance matching is possible also in the bent part. As a result, a transmission characteristic of a high-frequency signal can be improved.

Further, since the lead 14 projects from the outer wall 23 connected to the bent portion 15 in the second terminal portion 12, a distance between the outer wall 23 of the second terminal portion 12 and the cover 64 of the outer conductor terminal 60 and a distance between the lead 14 and the cover 64 of the outer conductor terminal 60 can be equal, and impedance matching is possible also on the side of the lead portion 14.

Furthermore, the accommodating portion 41 conventionally has a diameter reduced on the front end of the dielectric 40. However, in this embodiment, the accommodating portion 41 penetrates through the dielectric 40 in the front-rear direction while having the same diameter, and the thickness of the dielectric 40 does not change. Thus, impedance matching is possible also on the front of the dielectric 40.

Other embodiments are described briefly below.

The first terminal portion may be formed into a rectangular tube shape.

The second terminal portion may be formed into a hollow cylindrical shape.

The respective side panels may project from the second terminal portion to be located at both sides of the bent portion.

The respective side panels may project from both the first and second terminal portions to be located at both sides of the bent portion.

The side panels may be in contact with both left and right ends of the bent portion.

LIST OF REFERENCE SIGNS

10 inner conductor terminal
11 first terminal portion
12 second terminal portion
13 tab
14 lead
15 bent portion
16 side panel
21 first opening end
23 outer wall
29 second opening end
40 dielectric
41 accommodating portion
60 outer conductor terminal
100 shield terminal

What is claimed is:

1. An inner conductor terminal made of a metal plate, comprising:

tubular first terminal portion and second terminal portion each having an opening end;

a bent portion linking the first and second terminal portions, the bent portion covering the respective opening ends of the first and second terminal portions by facing the opening ends;

a tab projecting from an end part of the first terminal portion opposite to the opening end;

a lead projecting from an end part of the second terminal portion opposite from the opening end; and two side panels projecting from at least one of the first terminal portion and the second terminal portion to be located at both sides of the bent portion, the side panels covering a clearance between the bent portion, the first terminal portion and the second terminal portion from both sides.

2. The inner conductor terminal of claim 1, wherein the lead projects from an outer wall continuous with the bent portion in the second terminal portion.

3. A shield terminal with the inner conductor terminal of claim 1, comprising:

a dielectric for accommodating the inner conductor terminal; and an outer conductor terminal for surrounding the dielectric, wherein the first terminal portion is inserted into an accommodating portion of the dielectric from behind and rear ends of the side panels are exposed on a rear surface of the dielectric.

4. The shield terminal of claim 3, wherein:

the outer conductor terminal includes a surrounding portion for accommodating the dielectric, and a thickness of the dielectric defined between an inner surface of the surrounding portion and the first terminal portion is constant in a front-rear direction.

* * * * *